US010899486B2

(12) United States Patent
Wölfle et al.

(10) Patent No.: US 10,899,486 B2
(45) Date of Patent: Jan. 26, 2021

(54) PACKAGING MACHINE WITH STACKABLE PROTECTIVE COVERS

(71) Applicant: MULTIVAC SEPP HAGGENMÜLLER SE & CO. KG, Wolfertschwenden (DE)

(72) Inventors: Manuel Wölfle, Lauben (DE); Peter Weiss, Holzgünz (DE)

(73) Assignee: Multivac Sepp Haggenmüller SE & Co. KG, Wolfertschwenden (DE)

( * ) Notice: Subject to any disclaimer, the term of this patent is extended or adjusted under 35 U.S.C. 154(b) by 212 days.

(21) Appl. No.: 15/939,169

(22) Filed: Mar. 28, 2018

(65) Prior Publication Data

US 2018/0282005 A1 Oct. 4, 2018

(30) Foreign Application Priority Data

Mar. 30, 2017 (DE) ..... 10 2017 106 898

(51) Int. Cl.
*B65B 31/02* (2006.01)
*B65B 57/00* (2006.01)
(Continued)

(52) U.S. Cl.
CPC ..... *B65B 31/028* (2013.01); *B65B 7/162* (2013.01); *B65B 9/04* (2013.01); *B65B 57/005* (2013.01); *B65B 59/04* (2013.01)

(58) Field of Classification Search
CPC ..... B65B 7/162; B65B 31/028; B65B 9/04; B65B 59/04; B65B 57/005; B65D 21/00; B65D 21/0219; B65D 21/0223; B65D 21/0222; B65D 21/0209; B65D 5/001; B65D 5/0015; B65D 5/003; B65D 2543/00027
See application file for complete search history.

(56) References Cited

U.S. PATENT DOCUMENTS 2,561,262 A * 7/1951 Ziska ..... B65D 21/0217 229/5.5
2,655,067 A * 10/1953 Bechler ..... B23Q 11/08 82/152
(Continued)

FOREIGN PATENT DOCUMENTS

DE 7810224 U1 9/1978
DE 9014867 U1 2/1991
(Continued)

*Primary Examiner* — Thomas M Wittenschlaeger
(74) *Attorney, Agent, or Firm* — Husch Blackwell LLP

(57) ABSTRACT

A packaging machine comprising a sealing station with a sealing tool, a side frame and at least a first as well as a second upper protective cover respectively for placement onto a top side of the side frame during the manufacturing operations, wherein each of the two protective covers form a body with a lid, multiple side walls as well as a bottom. In one embodiment, the two protective covers can be stacked on one another, wherein at least one of the two protective covers forms at least one stack stop on the lid to which an edge of the floor of the other protective cover can be coupled in a removable way if the two protective covers are stacked on top of one another. In one embodiment, the packaging machine may be a deep-drawing packaging machine or a tray-sealing machine.

15 Claims, 2 Drawing Sheets

(51) Int. Cl.

| | |
|---|---|
| ***B65B 59/04*** | (2006.01) |
| ***B65B 7/16*** | (2006.01) |
| ***B65B 9/04*** | (2006.01) |

(56) References Cited

U.S. PATENT DOCUMENTS

| | | | | |
|---|---|---|---|---|
| 3,722,731 | A * | 3/1973 | McCormick | B65D 43/021 220/781 |
| 4,275,815 | A * | 6/1981 | Davis | B65D 21/0219 206/508 |
| 5,335,808 | A * | 8/1994 | Lee | B65D 17/4012 220/269 |
| 6,796,206 | B2 * | 9/2004 | Li | B23Q 11/0891 82/117 |
| 7,603,827 | B2 * | 10/2009 | Boyer, Jr. | B65B 59/04 53/250 |
| 2007/0284276 | A1 * | 12/2007 | Luttik | B65D 21/022 206/508 |
| 2012/0291400 | A1 * | 11/2012 | Ehrmann | B65B 9/04 53/396 |
| 2014/0182246 | A1 * | 7/2014 | Gabler | B65B 57/005 53/396 |
| 2015/0274431 | A1 * | 10/2015 | Schmeiser | B29C 51/261 53/147 |

FOREIGN PATENT DOCUMENTS

| | | | |
|---|---|---|---|
| DE | 19920260 | A1 | 11/2000 |
| DE | 102008053665 | A1 | 5/2010 |
| DE | 102014100176 | B4 | 3/2017 |
| EP | 2749499 | A1 | 2/2014 |
| EP | 2923955 | A2 | 9/2015 |

* cited by examiner

PACKAGING MACHINE WITH STACKABLE PROTECTIVE COVERS

CROSS-REFERENCE TO RELATED APPLICATIONS

This Application claims priority to German Patent Application No. 10 2017 106 898.8, filed on Mar. 30, 2017, to Manuel Wölfle and Peter Weiss, currently pending, the entire disclosure of which is incorporated herein by reference.

BACKGROUND OF THE INVENTION

To guarantee safe manufacturing operations, protective covers have been used up to present on a packaging machine, in particular on a deep-drawing packaging machine or on a tray-sealing machine, along a production track, for example ahead of and after a forming and/or sealing station, that can prevent operators from reaching into the production flow. So far, solutions have been known in which the protective covers are laid loosely onto a top side of the machine rack. For producing an access into the packaging machine, the protective covers are simply removed.

In this context, it is problematic that no suitable storage location is provided for the protective covers so that the operator puts the removed protective covers unavoidably next to the packaging machine, i.e. on the floor of the hall/building or adjacent to the machine, or that the protective covers are leaned against the machine rack of the packaging machine in an unsecured way or placed in an unsecured way at a point on the packaging machine that is not intended for this purpose. This can lead to the formation of stumbling blocks as well as damages on the protective covers and/or on the packaging machine. In addition, the remaining manufacturing operations can be disturbed by protective covers that are lying around. In addition, placing the protective covers on the floor of the hall is undesired due to the high hygiene standards for the manufacturing operations.

EP 2 749 499 A1 discloses a packaging machine that is formed as a tray-sealing machine and that provides protective covers ahead of and after a sealing station when viewed in the production flow that are formed in a way as to be tiltable from the operator side in the direction of the rear of the packaging machine in order to enable good accessibility to the areas that are blocked by the protective cover during operations.

SUMMARY OF THE INVENTION

The object of the invention is to provide a packaging machine, preferably a deep-drawing packaging machine or a tray-sealing machine that enables both improved manufacturing operations as well as a safe and improved maintenance and cleaning process. In particular cost-efficient media that can be used on different machine models and that are suitable for the high hygiene requirements of the manufacturing operations, are used for this purpose.

This problem may be solved by one embodiment of a packaging machine in accordance with the present invention. The packaging machine according to the invention, in one embodiment, may be in particular a deep-drawing packaging machine or a tray-sealing machine, comprises a sealing station with a sealing tool, a side frame and at least one first upper protective cover as well as one second upper protective cover that are formed respectively for placement onto a top side of the side frame during the manufacturing operations. The two protective covers respectively may have a body with a lid, multiple side walls as well as a bottom.

According to the invention, the two protective covers may be designed in a way as to be stackable on top of one another, wherein at least one of the two protective covers forms at least one stack stop on the lid to which an edge, which may be provided on the bottom of the other protective cover, can be removably coupled when the two protective covers are stacked on top of one another in one embodiment. The stack stop enables the stacked protective covers to be held stably on top of one another and towards one another. The stacked protective cover can be prevented from sliding down by the stack stop forming a sufficiently high ledge for the bottom edge of the supported protective cover so that the floor edge can lie sufficiently firmly on said ledge.

As the protective covers of the invention are themselves formed to be stacked safely on top of one another, the protective covers can still be placed loosely on the top side of the side frame so that a stack formation can take place at different locations, for example at different places on the side frame.

Additional mechanical means for holding the protective covers, for example swivel devices or separate bearing devices, for example a pallet for placing the protective devices next to the packaging machine or transport trolleys provided for this purpose, are no longer needed during a cleaning or maintenance process in view of the invention. Altogether, the manufacturing process of the packaging machine can therefore be implemented more cost-efficiently and the packaging machine takes up less space during its operation.

The invention enables the protective covers to remain on the packaging machine for cleaning or maintenance works, i.e. so that they do not have to be placed on the floor of the hall at a distance from the packaging machine whereby the protective covers could be damaged and were more prone to contamination. Due to the reduced number of the used overall components for handling of the protective covers, potential places of sedimentation for contaminants can be restricted further.

Due to the fact that the respective protective covers can be placed on one another in a way as to form a stable, slide-proof stack tower, they can remain on the packaging machine both during manufacturing operations as well as for a maintenance or cleaning process so that the packaging machine remains formed in a compact way both during manufacturing operations as well as during performance of cleaning or maintenance works and may be less prone to contamination as a whole. This has in particular also a favorable effect on the remaining manufacturing operations.

Preferably, the stack stop may be formed integrally on the lid of the protective cover. This simplifies the manufacturing process and ensures the lid to be suitable for the highest hygienic requirements. In addition, the stack stop can be formed in a particularly discreet way on the lid in this way.

According to a variant embodiment, the stack stop may be pressed into the lid of the protective cover by means of a reshaping process and forms a ledge. The pressing and/or punching of the stack stop into the lid can be performed for example by means of a forming tool, in particular by means of a forming pin that may be impinged by pressure. Then, the stack stop forms a sufficiently high elevation on the lid onto which the bottom edge of a protective cover, which may be stacked on top of the lid, can dock on safely in order to form a stack. In accordance with the existing ductility of the lid material, the plastic pressing process can be performed in a way that the stack stop forms a surface that may be crack-free as a whole together with the lid surface.

It may be advantageous for the stack stop to comprise an indentation with an arc-shaped edge. The indentation can form a dome-like elevation that can in particular be integrated expediently in the lid. In addition, the arc-shaped edge can be available both as a guiding and/or as a fastening means for a protective cover that may be stacked on top of it. Preferably, the arc-shaped edge forms an opening together with the lid that leads to the inside of the protective cover. Through the opening, a material tension in the area of the stack stop can generally be reduced so that there may be no risk of cracks on said stack stop. The arc-shaped edge can in particular be formed as an exact edge if the lid as a blank part may be cut on at least one point on which the pressing process may be performed, for example in form of an even cut, in order to form the stack stop, in particular the indentation, adjacent to it.

Preferably, a plane, which may be taken up by the arc-shaped edge, may be formed in a way as to be inclined at an acute angle to a horizontal plane when viewed in a vertical projection plane. In other words, the plane that may be taken up by the arc-shaped edge forms a sloped plane in relation to a horizontal plane. The plane that may be taken up by the arc-shaped edge may be inclined primarily to an outer edge of the lid in a slant way. Therefore, the arc-shaped edge can serve particularly well as a positioning aid and/or aligning aid for the operator when a stacked protective cover may be to be positioned on it.

In accordance with the high hygiene standards, it can be particularly advantageous if a plane, which may be taken up by the lid, may be inclined in relation to a plane that may be taken up by the bottom of the protective cover. The lid therefore forms a gradient on which cleaning agents can flow away well, be it in the stacked or in the non-stacked state.

The stack stop may be preferably formed respectively on opposite sides of the lid. The respective stack stops can thereby be formed in a way as to be opposite to one another on the lid and in particular aligned transversally to the production direction. In particular, the respective arc-shaped edges of the stack stops can be aligned along the production direction. In this context, a distance between the two stack stops may be mainly chosen in a way that it corresponds essentially to a distance between opposite bottom edges of a protective cover that may be stacked on top. Consequently, a stack of protective covers can be formed stably.

Preferably, the stack stop may be formed on the lid in a way as to be aligned to counteract a downforce of a protective cover stacked on the lid that acts along the inclination direction of the lid in order to secure the protective cover against sliding away along the inclined lid. Therefore, even slant stacks of protective covers that are placed on top of one another can be formed in a stable manner.

Preferably, the bottom of the protective cover comprises at least partially a circumferential/perimeter flange that forms the edge for coupling on the stack stop. Preferably, the circumferential/perimeter flange may be formed integrally on the protective cover, preferably as one part on at least one side wall and further preferably in a way as to be bent inwards. Therefore, the protective cover may be formed stably and can be fastened removably on a stack stop of a protective cover positioned underneath in an excellent way. The circumferential/perimeter flange forms at the same time a preferred stand surface that can lie evenly on a lid surface of a protective cover that may be stacked underneath.

The protective covers can be stacked on top of one another particularly stably if the lid of the protective cover forms at least partially a support surface for the bottom of the protective cover stacked on top. Preferably, the support surface may be formed in accordance with a bottom area of the circumferential/perimeter flange of the protective cover arranged on top so that the protective covers can lie on top of one another in a slide-proof way.

According to a particularly preferred embodiment, the protective covers can be stacked on the top side of the side frame so that the operator does no longer have to remove the protective covers from the packaging machine for maintenance and/or cleaning works. In other words, the protective covers can always remain on the packaging machine, wherein better hygiene standards can be fulfilled.

Preferably, the protective covers can be stacked on top of one another according to their alignment during manufacturing operations if they are positioned on the top side of the side frame. Seen from the point of view of an operator, this enables a particularly ergonomic stacking process of the protective covers. In addition, there can be essential advantages for a cleaning process if the respective lid parts of the protective covers stacked on top of one another are formed in an inclined way so that cleaning agents can flow away on it in an excellent way.

Another variant provides that the protective covers can be stacked on top of one another in a way as to be twisted horizontally by 180° in relation to their alignment during the manufacturing operations. As a whole, this enables the formation of a straight vertical stack tower that may be particularly stable.

The protective covers preferably have a twisting protection so that the protective covers can only be stacked according to a predetermined orientation, in particular their orientation during the manufacturing operations. Therefore, a stack of protective covers could be established systematically for a cleaning process. In addition, structural errors of a stack could be avoided this way.

The protective covers comply with particularly high hygiene requirements when they are formed as one part. This can for example occur by means of a bending and/or folding process. The protective covers can in particular be formed as one part of a thin-walled metal sheet. Preferably, the thin-walled metal sheet may be formed of a hygienic metal alloy, in particular according to other (cladding) components of the packaging machine.

In one embodiment, the lid of the protective cover may comprise at least one window. Therefore, there will be a possibility to look into the zone that may be blocked by the protective cover to that the operator can diligently follow the manufacturing process through the window even during the manufacturing operations. It would also be conceivable that at least one of the protective covers, preferably its lid, may be formed at least partially of a perforated metal sheet. Hence, the production flow could be observed well because the respective holes of the perforated metal sheet provide a viewing possibility. In addition, the overall weight of the protective cover could be reduced in this way. The protective cover can be handled in a particularly ergonomic way if the lid of the protective cover has a grip. Said grip may be arranged in particular in a centered way on the lid. Therefore, the operator can lift the protective cover easily.

According to an embodiment, it would also be possible for the stack stop itself to be formed as a hand grip. Therefore, the manufacturing process for the protective cover could be made more cost-efficient and in addition the protective cover could be formed in a more compact manner.

It would also be conceivable that a trough, which may be suitable for gripping and lifting the protective cover, may be formed in at least one of the side walls.

Other aspects and advantages of the present invention will be apparent from the following detailed description of the preferred embodiments and the accompanying drawing figures.

DESCRIPTION OF THE SEVERAL VIEWS OF THE DRAWING

In the following, an advantageous embodiment of the present invention will be explained in more detail making reference to a drawing, in which the individual figures show.

DETAILED DESCRIPTION OF THE INVENTION

Figure 1:
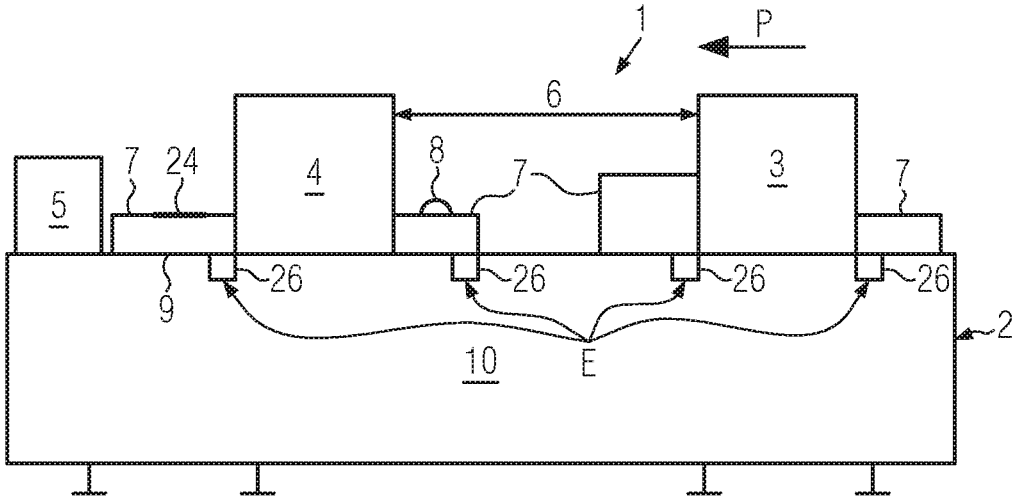
FIG. 1 is a schematic view of one embodiment of a packaging machine in accordance with the teachings of the present disclosure and having protective covers positioned on said machine during the manufacturing operations.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 schematically displays a side view of an operating side with a packaging machine 1 according to the invention that is formed as a deep-drawing packaging machine. The packaging machine 1 has a machine rack 2, a forming station 3, a sealing station 4 and a cutting station 5. The forming station 3 forms troughs into a lower film that is not shown in greater detail. The troughs of the lower film are filled with products along an inserting track 6. At the sealing station 4, a lid film, which is not shown in greater detail, is sealed onto the lower film after the inside of the trough has been evacuated and/or gassed in order to increase the shelf life for example of foodstuffs. The packagings formed in the film laminate of the lower film and the lid film are separated at the cutting station 5 and transported mechanically out of the packaging machine 1 or taken out of said packaging machine manually.

Certain areas directly ahead or after the forming station 3, the sealing station 4 and/or the cutting station 5 have to be protected from the operator reaching in from above, for example to avoid injuries while reaching into a lifting gear. For this purpose, protective covers 7 are positioned according to FIG. 1 ahead of and after the forming station 3 as well as ahead of and after the sealing station 4. Preferably, the protective covers 7 are checked for their presence using a recording unit E formed on the packaging machine 1, in particular using sensors 26, so that in case of absence of one of the protective covers 7, in particular also in cases in which said protective cover is not positioned correctly on the packaging machine 1, for example in a tilted way, no machine start will be possible.

For maintenance, alteration or cleaning purposes, the protective covers 7 placed loosely on the machine rack 2 can be removed from their position. However, placing the protective covers 7 on the floor in the hall/building next to the packaging machine 1 is not desired, primarily for hygienic reasons. In particular in case of a cleaning process of the packaging machine 1, which is usually performed on a daily basis, the protective covers 7 have to be removed from their position in order to make the area underneath accessible for cleaning. In this context, the protective covers 7 themselves may also be positioned favorably for cleaning.

Depending on the zone to be protected, the protective covers 7 according to FIG. 1 can be formed with different sizes. In this context, however, the respective protective covers 7 are formed with the same width when viewed in the production direction P. However, FIG. 1 indicates that the respective protective covers 7 can be formed with different depths and/or heights when viewed in the production direction P. Also, protective covers 7 with the same size could be an option.

The protective cover 7 may be positioned exemplarily ahead of the sealing station 4 in FIG. 1 and may have a grip 8 that facilitates lifting of the protective cover 7 by an operator. The grip 8 can also be provided on the other protective covers 7 of FIG. 1.

FIG. 1 also shows that the respective protective covers 7 are placed onto a top side 9 of a side frame 10 of the packaging machine 1. The side frame 10 forms a part of the machine rack 2 of the packaging machine 1. According to FIG. 1, the protective cover 7 that is placed behind the forming station 4 when viewed in the production direction P has a window 24.

Figure 2:
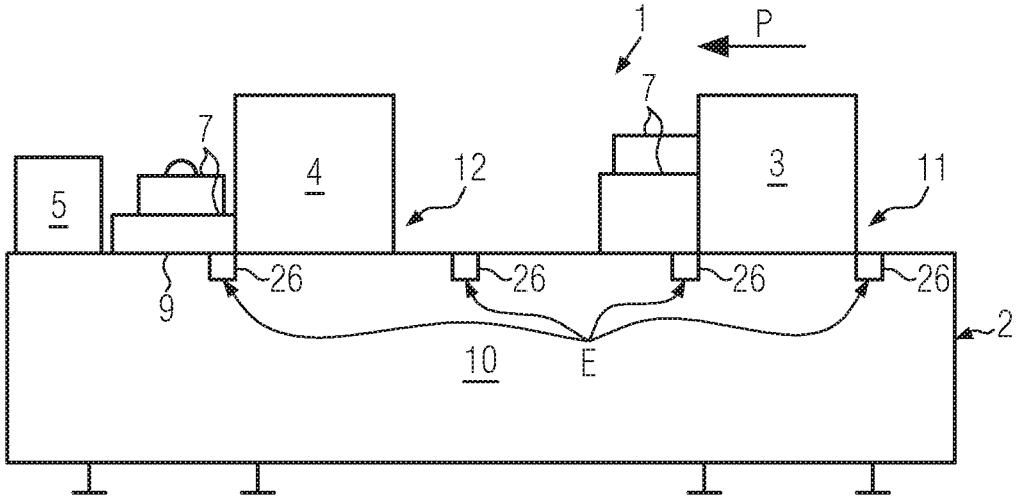
FIG. 2 is a schematic view of one embodiment of a packaging machine in accordance with the teachings of the present disclosure and shown during a manufacturing break and having protective covers stacked thereon.

FIG. 2 shows the packaging machine during a production stop in schematic side view. According to FIG. 2, respectively two protective covers 7 are stacked one on top of the other on the top side 9 of the side frame 10 of the packaging machine 1 in order to provide access to an input area 11 ahead of the forming station 3 and a further input area 12 ahead of the sealing station 4 when viewed in the production direction P. Therefore, a possibility to reach into the respective input areas 11, 12 is formed, so that cleaning and/or maintenance works are to be implemented in these zones. In spite of the exemplary illustration from FIG. 2, it would of course also be possible to position the respective stacked protective covers 7 ahead of the forming station 3 and/or the sealing station 4 when viewed in the production direction P in order to provide access to relevant output areas behind the forming station 3 and/or the sealing station 4. It would further be conceivable to form only one stack tower on the top side 9 of the packaging machine 1 in order to provide access to as many zones as possible of the packaging machine 1 at the same time for cleaning and/or maintenance works.

Figure 3:
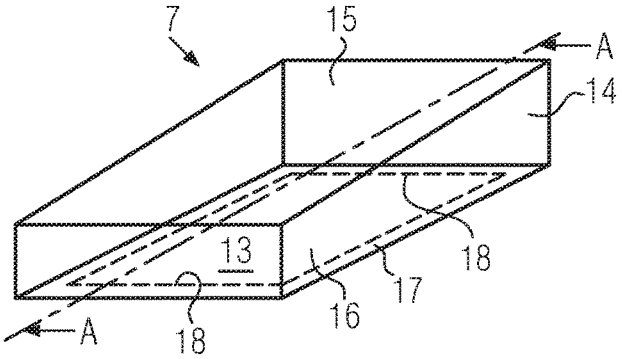
FIG. 3 is a schematic perspective view of one embodiment of a protective cover in accordance with the teachings of the present disclosure.

FIG. 3 shows the protective cover 7 in a perspective illustration as a body 13 that has side walls 14, a lid 15 as well as a bottom 16. The bottom 16 has a circumferential/perimeter flange 17 with an edge 18 formed on it that is formed according to FIG. 3 along the whole circumference/perimeter of the circumferential/perimeter flange 17. FIG. 3 further shows that a plane that is taken up by the lid 15 is formed in an inclined way in relation to a plane that is taken up by the bottom 16. This leads to protective covers 7 that are stacked on top of one another, at least when they are stacked according to FIG. 7, forming a slant stack tower when they are towered up on the top side 9 of the machine rack 2, wherein cleaning liquids can better flow away from the protective covers 7 that are stacked on top of one another during the cleaning process.

The body 13 of the protective cover 7 shown in FIG. 3 can be formed as one part of a thin-walled metal sheet.

Figure 4:
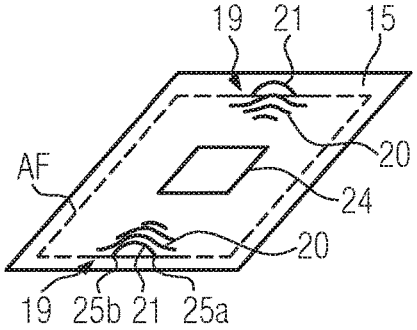
FIG. 4 is a schematic perspective view of one embodiment of a lid of a protective cover in accordance with the teachings of the present disclosure with stack stops formed thereon.

FIG. 4 shows the lid 15 schematically in a display that is isolated from the rest of the body 13. A stack stop 19 is formed respectively on opposite sides on the lid 15. The stack stops 19 are arranged in a way as to be opposed to one another. Between the stack stops 19, the window 24, which provides a possibility of viewing a zone that is covered by the lid 15 during the manufacturing operations, is formed in the lid 15. In addition, the lid 15 has a support surface AF, on which the flange 17 from FIG. 3 is lying when the protective covers 7 are stacked up.

The following description of the stack stop 19 applies in particular for the other stack stop 19 as well.

The stack stop 19 is formed as one part in the lid 15. The stack stop 19 forms a ledge to which the edge 18 of the bottom 16 can be coupled in a removable way when the protective covers 7 are stacked on top of one another. Therefore, the stacked protective covers 7 can be oriented towards one another and it is further possible to ensure that the stacked protective covers 7 remain positioned stably on top of one another.

According to FIG. 4, the stack stops 19 are formed respectively as an indentation 20. The respective indentations 20 can be pressed into the lid 15 through a reshaping process, for example by means of a forming pin impinged by pressure. Further, the respective indentations 20 each may have an arc-shaped edge 21 according to FIG. 4. The arc-shaped edge 21 defines the height of the ledge formed by the stack stop 19 and provides two docking points 25*a*, 25*b* on the transition area of said ledge to the lid 15 that are hit by the edge 18 when two protective covers 7 are stacked on top of one another. For manufacturing of the indentation 20 including the arc-shaped edge 21 formed on said indentation, a preferably straight cut can be provided in the sheet blank in the lid 15 so that the indentation 20 adjacent to it as well as the arc-shaped edge 21 can be produced out of it in an exact way, i.e. without creating any cracks in the material.

Figure 5:
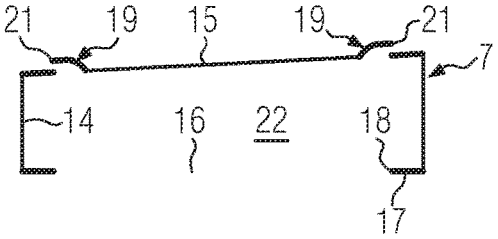
FIG. 5 is a schematic section view of the protective cover of FIG. 3 cut along the line A-A.

FIG. 5 shows a schematic section display according to A-A of the protective cover 7 from FIG. 3 with the lid 15 according to FIG. 4. In this view, it can be seen well that the lid 15 can be formed in a way as to be inclined in relation to the floor 16. In addition, FIG. 5 shows that the protective cover 7 can be formed as a hollow body in a way that it comprises an inner space 22.

Figure 6:
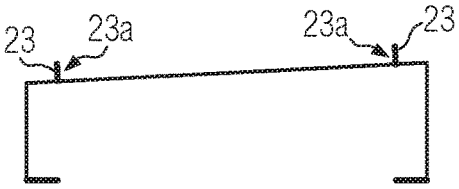
FIG. 6 is a schematic section view of one embodiment of a protective cover similar to that of FIG. 5 in accordance with the teachings of the present disclosure and having centering pins.

FIG. 6 shows an embodiment of the protective cover 7 with centering pins 23 on the lid 15. The centering pins 23 can be provided in addition or alternatively to the stack stops 19 according to FIGS. 4 and 5 in order to enable stacking of multiple protective covers 7 on top of one another in an even more exact way. For this purpose, openings 26 (see FIG. 7) can be formed respectively in accordance with the centering pins 23 in the bottom 16, in particular in the circumferential/perimeter flange 17 of the bottom 16, into which the centering pins 23 can be plugged in when two protective covers 7 are stacked on top of one another.

It would also be conceivable that only one of the two centering pins 23 is provided as a twisting protection 23*a* for a lid 15 displayed according to FIGS. 4 and 5. In addition to the stack stops 19 already provided, such a centering pin 23 could ensure as a twisting protection that protective covers 7 that are stacked on top of one another can only form a predetermined stack tower, for example a slant stack tower according to FIG. 7 so that cleaning agents can flow away better.

Figure 7:
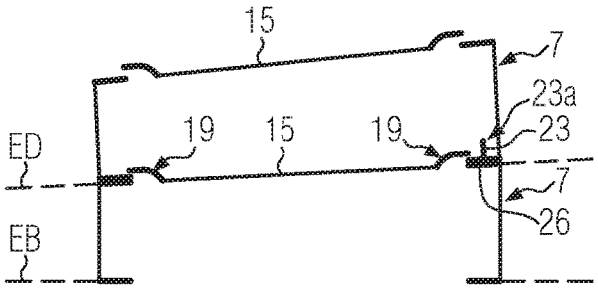
FIG. 7 is a schematic section view of an embodiment showing two stacked protective covers during the manufacturing operations in accordance with the teachings of the present disclosure.

FIG. 7 shows, as already indicated further above, a slant stack tower in which two protective covers 7 are stacked on top of one another in a predetermined inclined orientation. For this purpose, the lower protective cover 7 provides the centering pin 23 in the lid 15, which can be plugged into the opening 26 that is formed in the circumferential/perimeter flange 17 of the protective cover 7 disposed on top in order to stack the two protective covers 7 on top of one another in accordance with a slant tower. As can be seen in FIG. 7, the two lids 15 disposed on top of one another are each oriented in a slant position so that they form respectively a gradient of which cleaning agents can flow away better.

Figure 8:
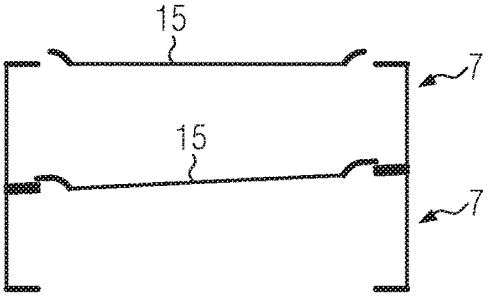
FIG. 8 is a schematic section view of an embodiment showing stacked protective covers twisted by 180° in relation to their manufacturing orientation in accordance with the teachings of the present disclosure.

FIG. 8 shows a stack tower that extends upwards in a straight (vertical) way and in which two protective covers 7 are stacked on top of one another in such a way that the lower lid 15 is inclined and the lid 15 positioned on top is oriented horizontally again. This can facilitate the formation of stable stacks. Nevertheless, this does not seem to be essential in view of the considerable potential of improved hygiene standards thanks to a tower according to FIG. 7. The packaging machine 1 according to the invention provides constructive technical means, wherein an operation that is improved as a whole, in particular improved maintenance and cleaning works, can be performed in view of safety aspects as well as with regard to ergonomics and in particular in view of high hygiene standards.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A packaging machine comprising:

a sealing station with a sealing tool;

a side frame; and at least a first upper protective cover and a second upper protective cover, each of said first and second upper protective cover being disposed on a top side of the side frame during manufacturing operations;

wherein each of the first upper protective cover and the second upper protective cover comprise a body with a lid, multiple side walls, and a bottom;

wherein the first upper protective cover and the second upper protective cover are configured to be disposed in a stacked arrangement, wherein one of the first upper protective cover or the second upper protective cover is on top of the other one of the first upper protective cover or the second upper protective cover; and wherein said one of the first upper protective cover or the second upper protective cover includes at least one stack stop on the lid to which an edge of the bottom of the other one of the first upper protective cover or the second upper protective cover can be removeably engaged when the first upper protective cover and the second upper protective cover are in said stacked arrangement;

wherein the at least one stack stop is an indentation that forms a raised ledge that is pressed into the lid of one of the first upper protective cover or the second upper protective cover; and wherein the at least one stack stop comprises at least two elements, with at least a first one of the at least two elements being disposed on a first side of the lid and at least a second one of the at least two elements disposed on a second side of the of the lid, wherein the first side and the second side are opposite sides of the lid.

2. The packaging machine according to claim 1, wherein the at least one stack stop is formed integrally on the lid of one of the first upper protective cover or the second upper protective cover.

3. The packaging machine according to claim 1, wherein the indentation of the at least one stack stop comprises an arc-shaped edge.

4. The packaging machine according to claim 1, wherein the lid is positioned in a first plane, and the bottom includes a flange extending at least partially around a perimeter of the bottom that defines a second plane, and wherein said first plane is inclined in relation to the second plane.

5. The packaging machine according to claim 1, wherein the bottom of one of the first upper protective cover or the second upper protective cover includes a flange extending at least partially around a perimeter of the bottom, wherein the flange defines the edge for engagement with the at least one stack stop of the other one of the first upper protective cover or the second upper protective cover.

6. The packaging machine according to claim 1, wherein the lid of at least one of the first upper protective cover or the second upper protective cover forms a support surface for the bottom of the other one of the first upper protective cover or the second upper protective cover stacked on it in the stacked arrangement.

7. The packaging machine according to claim 1, wherein at least the first upper protective cover and the second upper protective cover can be stacked on the top side of the side frame.

8. The packaging machine according to claim 1, wherein at least the first upper protective cover and the second upper protective cover can be stacked according to an orientation of the respective first upper protective cover and the second upper protective cover during the manufacturing operations when they are positioned on the top side of the side frame or in an orientation that is twisted horizontally by 180° relative to the orientation during the manufacturing operations.

9. The packaging machine according to claim 1, wherein at least one of the first upper protective cover and the second upper protective cover comprise a twisting protection device capable to align the protective covers so that the protective covers will be stacked securely in a predetermined stacking arrangement.

10. The packaging machine according to claim 1, wherein at least one of the first upper protective cover and the second upper protective cover are formed as one part.

11. The packaging machine according to claim 1, wherein the lid of at least one of the first upper protective cover and the second upper protective cover comprises a window.

12. The packaging machine according to claim 1, wherein the lid of at least one of the first upper protective cover and the second upper protective cover has a grip.

13. The packaging machine according to claim 1, wherein the at least one stack stop is a hand grip.

14. The packaging machine according to claim 1, wherein the packaging machine is one of a deep-drawing packaging machine or a tray-sealing machine.

15. A packaging machine comprising:

a sealing station with a sealing tool;

a side frame; and at least a first upper protective cover and a second upper protective cover, each of said first and second upper protective cover being disposed on a top side of the side frame during manufacturing operations;

wherein each of the first upper protective cover and the second upper protective cover comprise a body with a lid, multiple side walls, and a bottom;

wherein the first upper protective cover and the second upper protective cover are configured to be disposed in a stacked arrangement, wherein one of the first upper protective cover or the second upper protective cover is on top of the other one of the first upper protective cover or the second upper protective cover; and wherein said one of the first upper protective cover or the second upper protective cover includes at least one stack stop on the lid to which an edge of the bottom of the other one of the first upper protective cover or the second upper protective cover can be removeably engaged when the first upper protective cover and the second upper protective cover are in said stacked arrangement; and wherein the at least one stack stop is an indentation that forms a raised ledge that is pressed into the lid of one of the first upper protective cover or the second upper protective cover;

wherein at least one of the first upper protective cover and the second upper protective cover comprise a twisting protection device capable to align the protective covers so that the protective covers will be stacked securely in a predetermined stacking arrangement; and wherein the twisting protection device comprises a centering pin in a lid of a lower one of the first upper protective cover and the second upper protective cover that is received into an opening in an upper one of the first upper protective cover and the second upper protective cover.

* * * * *